US007114362B2

(12) United States Patent
Mitchell et al.

(10) Patent No.: US 7,114,362 B2
(45) Date of Patent: Oct. 3, 2006

(54) METHOD OF MAKING METAL WORKPIECE

(75) Inventors: George A. Mitchell, Poland, OH (US); Paul F. Russo, New Castle, PA (US)

(73) Assignee: George A. Mitchell Company, Youngstown, OH (US)

( * ) Notice: Subject to any disclaimer, the term of this patent is extended or adjusted under 35 U.S.C. 154(b) by 144 days.

(21) Appl. No.: 10/811,054

(22) Filed: Mar. 27, 2004

(65) Prior Publication Data

US 2005/0210950 A1 Sep. 29, 2005

(51) Int. Cl.
*B21C 37/16* (2006.01)

(52) U.S. Cl. ..... 72/370.25; 72/283; 72/276

(58) Field of Classification Search ..... 72/274, 72/276, 370.14, 370.16, 370.23, 370.24, 72/370.25, 467, 283
See application file for complete search history.

(56) References Cited

U.S. PATENT DOCUMENTS 1,728,016 A * 9/1929 Staples ..... 72/276
2,240,456 A * 4/1941 Darner ..... 72/276
3,399,559 A * 9/1968 Mitchell ..... 72/330
3,572,080 A * 3/1971 Alexoff et al. ..... 72/273.5
4,232,541 A * 11/1980 Stump ..... 72/283
4,961,576 A * 10/1990 Meredith ..... 473/323
5,353,618 A 10/1994 Roper
5,564,769 A 10/1996 Deneau
5,865,054 A 2/1999 Roper
5,934,733 A 8/1999 Manwaring
6,520,849 B1 2/2003 Greenwald
6,735,998 B1 * 5/2004 Mitchell ..... 72/370.25

* cited by examiner

*Primary Examiner*—Dmitry Suhol
(74) *Attorney, Agent, or Firm*—Clifford A. Poff

(57) ABSTRACT

A method for draw forming a desired contour to the outer diameter of a tubular work piece provides that the selected work piece have a wall thickness uniform throughout its length. The outer diameter of selected work piece is reduced along essentially only a part of the starting metal blank by drawing the metal blank only partly through a die or only partly through each one of a succession of dies. The resulting drawn reduced diameter will have essentially the same wall thickness as the starting blank. If a thinner wall thickness is desired on the reduced outside diameter, an internal mandrel can be inserted in the starting tube, which will work with the draw die to decrease the resulting wall thickness of the drawn tube to an amount less than the starting tube. The workpiece recovered after the drawing method is useful for producing an automotive fuel tank filler tube or an automotive instrument panel support beam.

18 Claims, 3 Drawing Sheets

METHOD OF MAKING METAL WORKPIECE

BACKGROUND OF THE INVENTION

1. Field of the Invention

This invention relates to a method of draw forming a desired contour along outer diameter of a tubular workpiece, and more particularly, to such a method for controlling and minimizing an unwanted increase to the wall thickness along the altered contours of the tubular workpiece useful particularly to form a tubular metal workpiece having contours to meeting stringent shape and wall thickness requirements.

2. The Prior Art

The metal working operations of the present invention alter the surface contour of a tube comprised of ferrous or non-ferrous metal and the form of any of diverse cross sectional configurations, including rounds, squares and rectangles. The metal working operations are particularly useful to provide workpieces for the manufacture of automotive fuel tank filler tube or an automotive instrument panel support beam. The methods of manufacturing contoured workpiece used for the manufacture of an automotive instrument panel support beam are diverse and include die casting of light metals such as aluminum and magnesium and metal extrusions. Examples of instrument panel structures are disclosed in U.S. Pat. Nos. 5,564,769 and 5,934,733 for use in a vehicle having opposing side pillars, so called "A Pillars." A complex molding of plastic material is disclosed in U.S. Pat. No. 6,520,849. In one exemplary disclosure by Pat. No. 6,520,849, there is an integrated structural HVAC system called an ISHS that includes two sections with the ISHS first section having a molded first cross beam which includes integral molded features and the ISHS second section likewise comprises a molded second cross beam having integral molded features. In the second exemplary disclosure by U.S. Pat. No. 5,564,769, there is a reinforced instrument panel assembly capable of being preassembled and then installed as a unit in a motor vehicle. Hydroforming of steel tubing is known in the art and two examples are disclosed in U.S. Pat. No. 5,353,618 a related divisional Pat. No. 5,865,054, both providing an apparatus for forming a frame member for an automobile from a tube blank by applying internal hydraulic pressure to the blank, tangent bends and preforms the internally pressurized blank into a preformed tube having a desired horizontal profile configuration, then forms the preformed tube into a finally formed frame member having a desired vertical profile configuration and a desired, varying cross-sectional configuration by placing the preformed tube in a stuffing ledge apparatus having a lower die with an upwardly facing ledge and vertically extending, punch engaging surfaces and a punch having a downwardly facing ledge and vertically extending, die engaging surfaces, internally pressurizing the tube, and then ramming the punch downwardly to form the tube into the finally formed frame member, the ledges and vertically extending surfaces substantially completely enclosing a portion of the tube before and while the punch and die come together to form the tube into the finally formed frame member. The forming components in each apparatus are submerged in an aqueous bath, allowing the blank and tube to automatically fill themselves, thereby facilitating sealing and pressurizing of the tube. Such a cross beam arrangement is believed a lightweight and less costly to fulfill the need for an instrument panel support beam. An improvement to the construction of the instrument panel support beam follows important considerations in the selection of the tubular workpiece used in the hydroforming or competing manufacturing techniques for producing an automotive instrument panel support beam as well as an automotive fuel tank filler tube. Significant considerations for selecting the configuration of the tubular workpiece include the weight of the finished beam, dimensional stability, material costs, and production costs. A need is believed to exist for the provision of a preformed tubular metal workpiece having different diameters along the length and preferably the reduced diameter section having essentially the same or reduced wall thickness for use in a subsequent hydroforming or competing manufacturing process to form the desired automotive instrument panel support beam.

It is an object of the present invention to provide a process for reducing the diameter of essentially only a select length of a tubular metal blank by the use of tension applied to pull the metal blank in a die or a succession of dies so that the reduction to the diameter of the tube is accompanied by a minimum of thickening to the wall thickness and if desired a reduction to this wall thickness.

It is still another object of the present invention to provide a two step drawing operation using contour dies to produce an elongation and a contouring of unitary tubular metal workpiece for the manufacture of an automotive instrument panel support beam.

It is another object of the present invention to provide a draw forming operation for a tubular workpiece wherein multiple drawing operations are performed with the second and any additional drawing operation being controlled to selectively impart a progressive stepped configuration of spaced apart reduced diameters spaced along the newly elongated length of only part of the tubular metal blank for the manufacture of an automotive instrument panel support beam.

The present invention seeks to minimize the wall thickness and thus also the weight of the metal tubular structure manufactured to form an automotive instrument panel support beam or an automotive fuel tank filler tube. The selected tubular metal workpiece with a uniform diameter throughout the length thereof is subject to metalworking operation selected to avoid the disadvantages arising out of the use of the rotary swaging and cold pilger processes by drawing the tubular metal blank only partly through a contoured die or a succession of contour dies. The drawing process operates to reduce the diameter of the metal tubular blank which greatly reduces increases to the tubular walls undergoing the reduction to the diameter particularly as compared to the unwanted thickness increases to the tubular walls when acted on by the rotary swaging or the cold pilger processes.

SUMMARY OF THE INVENTION

In accordance with the present invention there is provided a method for contouring a workpiece for an article of manufacture, the method including the steps of selecting a starting metal tube having a uniform wall thickness along the length thereof and a constant outside diameter substantially the same outside diameter as desired for producing a first constituent of length desired for the contoured workpiece, and drawing the starting metal tube only partly through a contoured die or only partly through each one of a succession of contoured dies to reduce the outer diameter essentially only along a part of the starting metal tube without producing an appreciable increase to the uniform wall thickness for producing a desired diameter along a second constituent length desired for the contoured workpiece. The contoured workpiece produced according to the present invention is useful for the manufacture of an automotive instrument panel support beam.

More specifically, in accordance with the present invention there is provided a method for contouring a workpiece for the manufacture of automotive fuel tank filler tube or an automotive instrument panel support beam, the method including the steps of selecting a starting metal tube having a uniform wall thickness along the length thereof and a constant outside diameter substantially the same outside diameter as desired for producing a first constituent of length in a workpiece for the manufacture of an automotive instrument panel support beam, and drawing the starting metal tube only partly through a contoured die or only partly through each one of a succession of contoured dies to reduce the outer diameter essentially only along a part of the starting metal tube without producing an appreciable increase to the uniform wall thickness for producing a second constituent of length in the workpiece for the manufacture of an automotive instrument panel support beam.

According to a further aspect of the present invention there is provided a method for contouring a workpiece for the manufacture of automotive fuel tank filler tube or an automotive instrument panel support beam, the method including the steps of selecting a starting metal tube having a uniform wall thickness along the length thereof and a constant outside diameter substantially the same outside diameter as desired for producing a first constituent of length in a workpiece for the manufacture of an automotive instrument panel support beam, and drawing the starting metal tube only partly through each one of a succession of contoured dies by stopping a first drawing motion by detecting a predetermined displacement of the starting metal tube from the contour of the contoured die to reduce the outer diameter essentially only along a part of the starting metal tube without producing an appreciable increase to the uniform wall thickness for producing a second constituent of length in the workpiece for the manufacture of an automotive instrument panel support beam. The preferred method is further characterized by providing that the step of drawing the starting metal tube further includes stopping a second drawing motion by sensing an increase to a drawing force developed when the contour of the contoured die contacts the contour developed by the preceding contoured die to thereby form a continuous smooth contour tapering wall section ranging in diameters between the first constituent and the second constituent of lengths in the workpiece for the manufacture of an automotive instrument panel support beam.

BRIEF DESCRIPTION OF THE DRAWINGS

These features and advantages of the present invention as well as others will be more fully understood when the following description is read in light of the accompanying drawings in which.

DETAILED DESCRIPTION OF THE INVENTION

Figure 1:
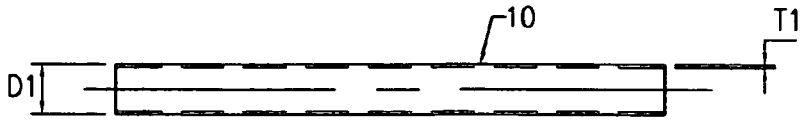
FIG. 1 is an illustration of a first selected tubular blank taken as a longitudinal section showing a constant wall thickness.
Figure 2:
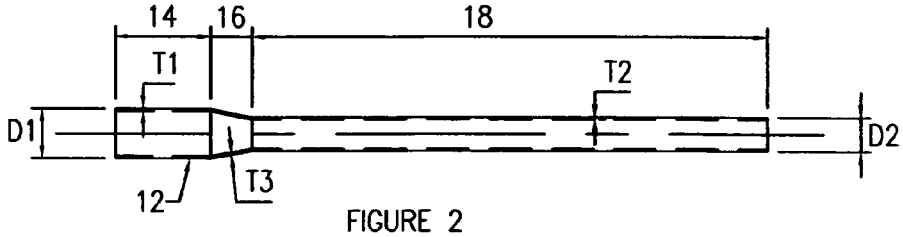
FIG. 2 is an illustration of a workpiece containing designations of wall thicknesses and component sections produced according to the present invention for the manufacture of an automotive fuel tank filler tube.

FIG. 1 illustrates a suitable starting tubular metal blank 10 for use in metal drawing operations according to one embodiment of the present invention for producing a workpiece having desired contours along the external surface for the subsequent making of an automotive fuel tank filler tube. The metal blank 10 is normally comprised of a ferrous metal e.g. carbon steel, or stainless steel with an elongated cylindrical configuration notably characterized by a uniform wall thickness T1 and a uniform diameter D1 throughout the entire length of metal blank. FIG. 2 illustrates a typical configuration of a workpiece 12 produced according to the method of the present invention before further metal working operations are carried out to produce the finished product. The wall thickness T1 and the diameter D1 of selected metal blank 10 are selected to correspond to the desired wall thickness and the desired diameter of a tubular inlet portion 14 substantially unaltered during the various metal working operations of the present invention. The drawing operation reduces the outer diameter to a diameter D2 essentially only along a part of the metal blank without producing a substantial increase to the uniform wall thickness T2 along a tubular delivery portion 18 and producing a generally small increase to the wall thickness T3 along the newly created truncated conical transition portion 16. In the past, reductions to the diameter of the metal blank by rotary swaging, push pointing or by the pilger process produce such a significant increase, i.e. between 80% and 100% increase, to the wall thickness of the metal blank due to the metal working operation. The thickness T2 and T3 as compared to the thickness T1 are generally a minimal amount of increase.

Figure 3:
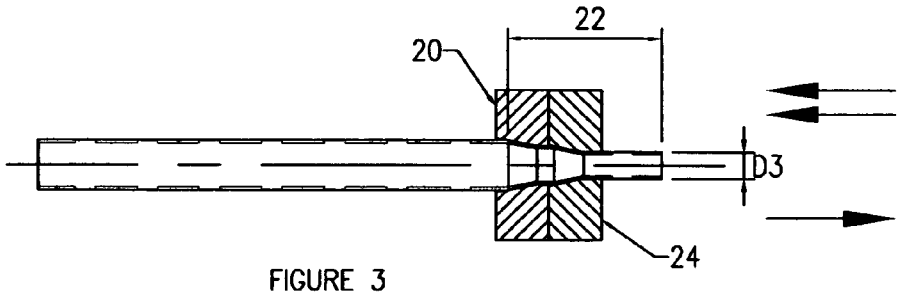
FIG. 3 is a sequence of illustration depicting blank pointing of a selected tubular metal blank.
Figure 4A:
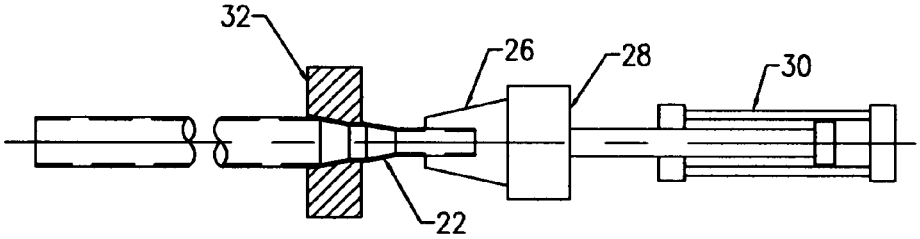
FIGS. 4*a*, 4*b*, and 4*c* are sequential illustrations showing the use of a contoured die for producing the workpiece shown in FIG. 2.
Figure 4B:
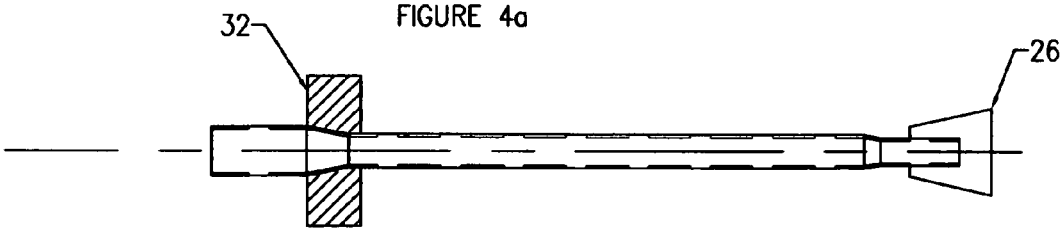
Figure 4C:
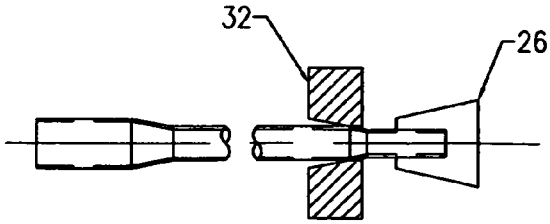

FIG. 3 schematically illustrates preliminary metal forming operations used to form a reduced diameter end portion on the selected metal blank by multiple push point reductions to the diameter of a short length of the blank 10. A first push point die 20 is used to produce a reduced diameter along an end portion 22 of the blank. A second push point die 24 is used to further reduce the end portion diameter to a diameter D3 and increase the length of the end portion 22 such that it is suitable for engagement by a gripper 26 shown schematically in FIGS. 4*a*, 4*b*, and 4*c*. An alternative to using push point dies 20 and 24 for producing end portion 22 is a rotary swaging process per se well known in the art. The gripper 26 is part of drawing machinery, per se well known in the art. The gripper is incorporated into a draw carriage 28 that is reciprocated by a hydraulically powered piston and cylinder assembly 30. The tube drawing operation according to the method of the present invention uses a position control for the piston and cylinder assembly to establish the length of tubular blank that is drawn through a contoured die 32 and thereby produce the desired diameter D2 and length 18. The die cavity of the contoured die is defined by an included angle generally within the range of 20 to 30 degrees, preferably in the range of 22 to 24 degrees. If required two consecutive drawing operations using suitably sized dies can be used to reduce the diameter of the tube blank sufficiently to produce the tubular delivery portion 18 without producing an appreciable or a substantial increase to the uniform wall thickness T2 and produce a generally small increase to the wall thickness T3 along the newly created truncated conical transition portion 16. The configuration of the contour die and the tension applied to the gripper 26 also produce the truncated conical transition portion 16. The location of portion 16 in the metal blank is established by stopping the drawing operation. The stoppage occurs only after a predetermined part of the metal blank is pulled through the die 32 as shown in FIG. 4*b*. Thereafter the carriage 26 is returned to the original start position as shown in FIG. 4*c* and the end portion 22 is released from the gripper 26. The partly drawn metal blank is removed from the drawing machine and, if desired, the end portions are trimmed. The resulting product shown in FIG. 2 comprises a preformed workpiece suitable for transfer to other metal working machinery to produce the desired automotive fuel tank filler tube.

Figure 5:
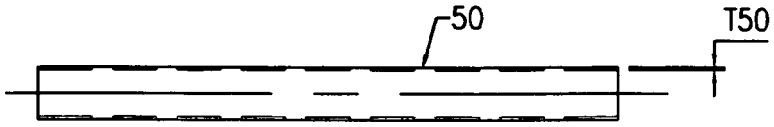
FIG. 5 is an illustration of a second selected tubular blank taken as a longitudinal section showing a constant wall thickness.
Figure 7:
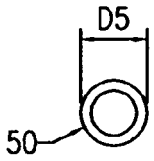
FIGS. 7, 8 and 9 are end elevational views of three alternative configurations of a tubular blank taken shown in FIG. 5.
Figure 8:
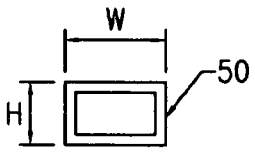
Figure 9:
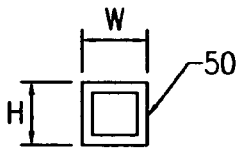
Figure 6:
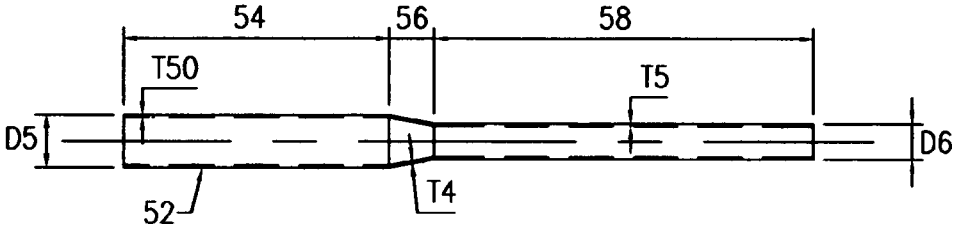
FIG. 6 is an illustration of a workpiece containing designations of wall thicknesses and component sections produced according to the present invention for the manufacture of an automotive instrument panel support beam.

The method of the present invention is also used to create desired contouring in a tubular metal blank 50 shown in FIG. 5 used as a workpiece for the manufacture of an automotive instrument panel support beam. It is within the scope of the present invention to select the metal blank 50 made of any suitable ferrous or nonferrous metal preferably steel, aluminum, or aluminum alloy, when steel is chosen the blank can be of a welded construction. The tubular metal blank 50 is notably characterized by a uniform wall thickness T50 throughout the entire length thereof and substantially constant outside dimension as desired for a first constituent of length 54 in a workpiece 52 shown in FIG. 6 for the subsequent manufacture of an automotive instrument panel support beam. The substantially constant outside dimensions comprise a diameter D5 when choosing a round as shown in FIG. 7 or a height H dimension and a width W dimension when choosing a rectangle as shown in FIG. 8, a square with equal height and width dimensions as shown in FIG. 9 is defined to belong to the class of rectangles. A round metal blank shown in FIGS. 5 and 7 is selected for the purposes of the detailed description of this aspect of the present invention. In the embodiment shown in FIG. 6, the constituent of length 54, nominally designated as a driver side support beam portion is substantially unaltered during the various metal working operations used to produce the transition portion 56 and passenger side support beam portion 58, called a second constituent of length in the workpiece for the manufacture of an automotive instrument panel support beam. The drawing operations utilized to form the transition portion 56 and passenger side support beam portion 58 may produce a generally small increase to the tapered wall thickness T4 along the final contour of the transition portion 56 and a slightly larger increase producing the final wall thickness T5 and diameter D6 along the final contour of the passenger side support beam portion 58. The portions 56 and 58 of the tubular metal blank are produced by one or more drawing operations according to the method of the present invention.

Figure 10:
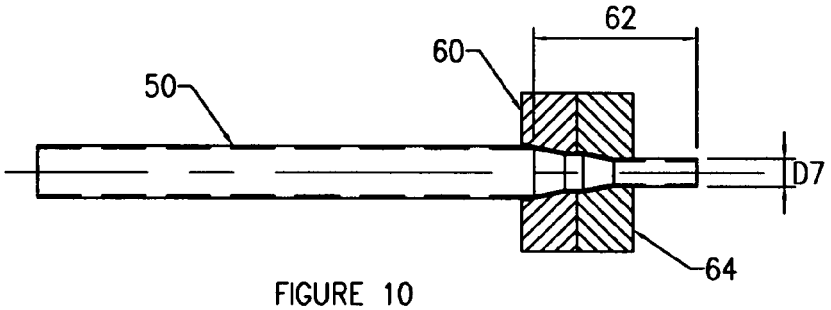
FIG. 10 is a sequence of illustration depicting blank pointing of a selected tubular metal blank.
Figure 11A:
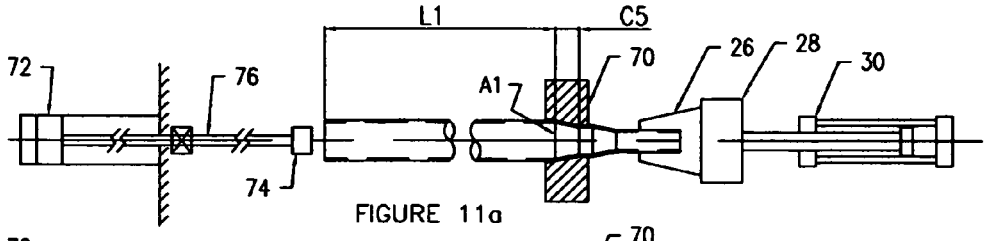
FIGS. 11*a*, 11*b*, 11*c*, 11*d*, 11*e*, 11*f*, and 11*g* are sequential illustrations showing the use of contoured dies for producing a continuous smooth contour tapering wall section ranging in diameters between the first constituent and the second constituent of lengths in a workpiece for the manufacture of an automotive instrument panel support beam according to the present invention.
Figure 11B:
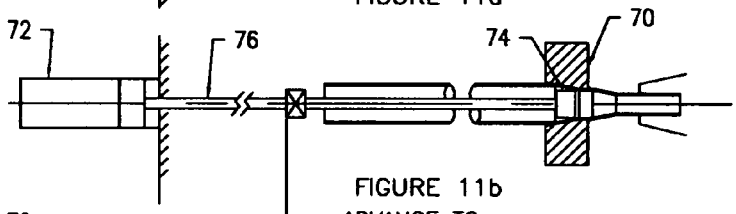

The metal forming operations schematically illustrated in FIG. 10 comprise preliminary metal forming operations used to form a reduced cross sectional size along end portion on the selected metal blank by multiple push point reductions to the diameter along a short length of the blank 50. A first push point die 60 is used to produce a reduction to the diameter along an end portion 62 of the blank. A second push point die 64 is used to further reduce the end portion size to diameter D7 and increase the length of the end portion 62 such that it is suitable for engagement by the gripper 26 shown schematically in FIGS. 11*a*–11*g*. An alternative to using push point dies 60 and 64 for producing end portion 62 is a rotary swaging process per se well known in the art. As explained hereinbefore, the gripper 26 is part of drawing machinery incorporating the draw carriage 28 and the gripper is reciprocated by a hydraulically powered piston and cylinder assembly 30. The tube drawing operation according to the method of the present invention uses a position control for the piston and cylinder assembly to establish the length of tubular blank that is drawn through a contoured die or dies. The die cavity of the contoured die is defined by an included angle generally within the range of 20 to 30 degrees, preferably in the range of 22 to 24 degrees. The metal blank is introduced in the die cavity of a contoured die 70 of the drawing machinery and the griper 26 engaged with the end portion 62 as shown in FIG. 11*a*.

Figure 11C:
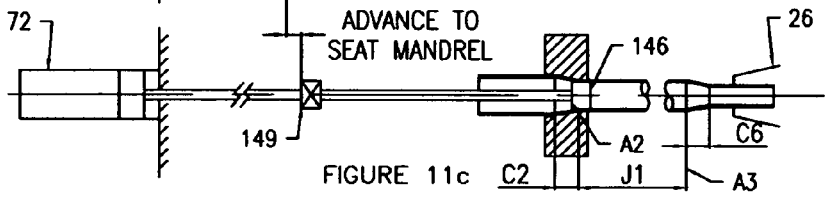
Figure 11D:
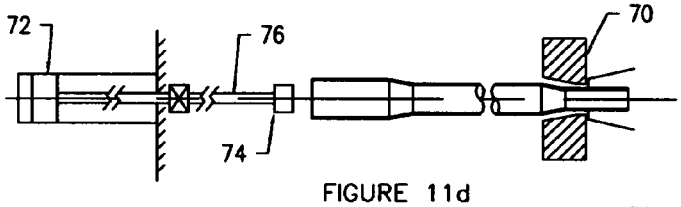
Figure 11E:
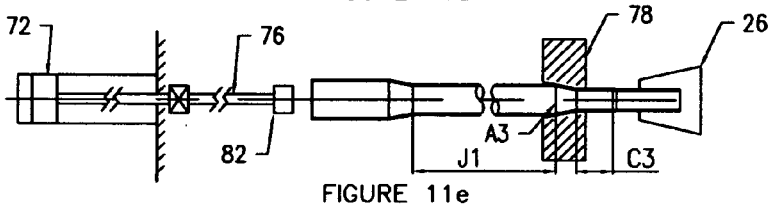
Figure 11F:
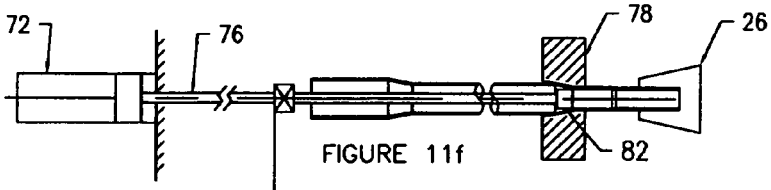
Figure 11G:
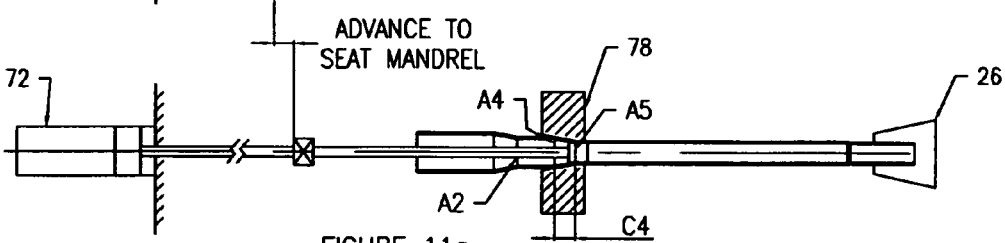

A piston and cylinder assembly 72 is then controlled to advance the mandrel 74 on the free end of a support rod 76 into the internal cavity of the truncated conical portion C1, which was created by the multiple push point reductions to the end portion 62. The piston and cylinder assembly 72 is then operated to again advance the mandrel 74 a relatively short incremental distance controlled to seat the mandrel 74 in load bearing contact with the internal surface of the blank residing in the die 70. The piston and cylinder assembly 30 is operated to partly pull the blank through the die 70 and establish as shown in FIG. 11*c* an elongated truncated conical length C2 terminating at a transverse plane A2 from which the transitional length J1 has emerged from the die 70 which creates a uniform decrease to the uniform wall thickness. The length of the truncated conical section C2 and J1 are established, when desired, by operation of a position sensing limit switch, not shown. The partly drawn blank is then removed from the die by first reversing the operation of the piston and cylinder assembly 72 to retract the mandrel 74 from the blank and then the blank is removed from the internal cavity of the tubular die 70 by reversing the direction of movement of the drawn end portion of the blank, as shown in FIG. 11*d*. After the blank is passed free and clear of the die cavity, the end portion 62 of the partly drawn blank is inserted in a die 78 and advanced initially to a point where the truncated conical length C3 establishes a seated contact with and wholly resides in the die cavity. The gripper 26 of the draw carriage then engages with the end portion of the drawn blank emerging from the exit end of the die 78. This relationship of the partly drawn blank to the die cavity of contoured die 78 is illustrated in FIG. 11*e*. The next steps in the present invention comprise a further drawing operation by operating a piston and cylinder assembly 72, as shown in FIGS. 11*e* and 11*f*, to advance a mandrel 82 within the internal cavity of the truncated conical end C3. The piston and cylinder assembly 72 is then operated to again advance a mandrel 82 a relatively short incremental distance to seat the mandrel 82 in load bearing contact with the portion of the blank residing in the internal surface of the die. The gripper 26 is operated to pull a selected increment or all of the transitional length J1 through the die and establish the second constituent of length 58. As shown in FIG. 11*g* an elongated truncated conical length C4 commences at a plane A4 and terminates at a transverse plane A5. In the embodiment of the automotive instrument panel support beam workpiece shown in FIG. 6, the drawing operation using the contoured die 78 is used to form one continuous truncated conical transition 56 between first constituent length 54 and the second constituent of length 58. Transition 56 is the aggregate of the transitions C2 and C4 occurring when the drawing operation using die 78 is continued until transitions C2 and C4 are continuous by limiting the magnitude of hydraulic pressure introduced to the piston and cylinder assembly 30. The pressure limiting function can be achieved by the use of a pressure relief valve in the fluid line delivering the hydraulic pressure to the piston and cylinder assembly. In this way, the second drawing motion is stopped part way along the blank by sensing an increase to a drawing force developed when the contour of the contoured die 78 contacts the contour developed by the preceding contoured die 70 to thereby form a continuous smooth contour tapering wall section ranging in diameters between the first constituent and the second constituent of lengths. The use of the mandrels 74 and 82 during the drawing operations form the external tapered surface free of surface markings. The wall thickness T4 along transition 56 and the wall thickness T5 along the passenger side support beam portion 58 are uniform and reduced to the desired thicknesses. The two step draw process increases the length of the tube blank 50, a typical example is a 20 inches overall increase in length using a starting metal tube blank with a length of 48.5 inches.

Figure 12:
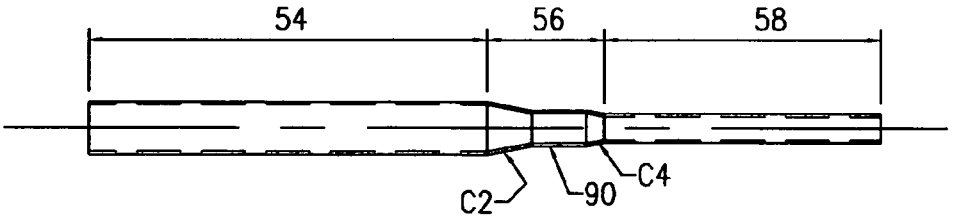
FIG. 12 is an illustration containing designations of wall thicknesses and component sections of a second typical workpiece for producing an automotive instrument panel support beam.

In the embodiment of the automotive instrument panel support beam workpiece shown in FIG. 12, the drawing operation using the contoured die 78 is useful to form a cylindrical section 90 between two spaced apart truncated conical transitions C2 and C4 thus forming an elongated transition portion 56. The cylindrical section 90 optimizes the tube strength and provides a possible mounting site for a support bracket, which would be fastened to the tube in the subsequent manufacturing operations to form the completed automotive instrument panel support beam workpiece.

While the present invention has been described in connection with the preferred embodiments of the various figures, it is to be understood that other similar embodiments may be used or modifications and additions may be made to the described embodiments for performing the same function of the present invention without deviating there from. Therefore, the present invention should not be limited to any single embodiment, but rather construed in breadth and scope in accordance with the recitation of the appended claims.

The invention claimed is:

1. A method for contouring a workpiece for the manufacture of an automotive instrument panel support beam, said method including the steps of:

selecting a starting metal blank having a uniform wall thickness along the length thereof and a constant outside dimension substantially the same outside dimension as desired for producing a drivers side support beam portion comprised of a first constituent of length of said starting metal blank for the manufacture of an automotive instrument panel support beam;

reducing the cross sectional size of an end portion of said starting metal blank remote to said drivers side support beam portion;

operating a gripper to engage said end portion produced by said step of reducing; and producing a passenger side support beam portion by using said gripper for drawing said starting metal blank only partly through a contoured die or only partly through each one of a succession of contoured dies to reduce the outside dimension essentially only along a part of said starting metal blank remaining between said driver side support beam portion and said end portion without producing an appreciable increase to said uniform wall thickness for producing a second constituent of length in the manufacture of an automotive instrument panel support beam.

2. The method according to claim 1 wherein said step of producing a passenger side support beam portion includes using tension only to apply contact pressure on said contoured die or said contoured dies by said starting metal blank to maintain essentially the same wall thickness along the reduced outer dimension of said starting metal blank along said second constituent of length.

3. The method according to claim 1 including the further step of working the metal wall of said starting metal blank concurrently with said step of producing a passenger side support beam portion to form said second constituent of length in said starting metal blank for manufacture of an automotive instrument panel support beam.

4. The method according to claim 3 wherein said step of working the metal wall of said starting metal blank includes contacting an internal wall section confronting said contoured die or said contoured dies with a mandrel concurrently with using tension to apply contact pressure on said contoured die or said contoured dies to both reduce the wall thickness and reduce said constant outside dimension along said second constituent of length in said starting metal blank for manufacture of an automotive instrument panel support beam.

5. The method according to claim 3 wherein said contacting an internal wall section includes seating a mandrel into the inside of said starting metal blank to a site confronting said contoured die or said contoured dies.

6. The method according to claim 1 wherein a length of said starting metal blank residing in said contoured die or contoured dies produces a tapering outside dimension ranging between said first constituent of length and said second constituent of length in said starting metal blank for the manufacture of an automotive instrument panel support beam.

7. The method according to claim 1 including the further step of cutting an increment of length essentially comprising said end portion from an end of said starting metal blank to define a desired aggregate length of a workpiece for the manufacture of an automotive instrument panel support beam.

8. The method according to claim 1 wherein said step of reducing the cross sectional size of an end portion includes forming a push pointed end segment on said starting metal blank for establishing a desired outside dimension for said step of producing a passenger side support beam portion.

9. The method according to claim 8 including the further step of severing said push pointed end from said starting metal blank following said step of producing a passenger side support beam portion.

10. The method of according to claim 1 wherein said step of producing a passenger side support beam portion includes using said contoured die or a succession of contoured dies to form a conical transition defined by an included angle within the range of 20 to 30 degrees.

11. The method of according to claim 10 wherein said included angle is in the range of 22 to 24 degrees.

12. The method of according to claim 1 wherein said starting metal blank is a welded steel.

13. The method of according to claim 1 wherein said starting metal blank is round.

14. The method of according to claim 1 wherein said starting metal blank is rectangular.

15. The method of according to claim 1 wherein said step of producing a passenger side support beam portion includes using said contoured die or a succession of contoured dies to form two spaced apart transitions between said first constituent of length and said second constituent of length.

16. The method of according to claim 15 wherein said step of producing a passenger side support beam portion includes using said contoured die or a succession of contoured dies to form two transitions defined by an included angle within the range of 20 to 30 degrees.

17. The method of according to claim 16 wherein said included angle is in the range of 22 to 24 degrees.

18. A method for contouring a workpiece for an article of manufacture, the method including the steps of:

selecting a starting metal blank having a uniform wall thickness along the length thereof and a constant outside dimension substantially the same outside dimension as desired for producing a first constituent of length desired for a contoured workpiece, reducing the cross sectional size of an end portion of said starting metal blank remote to said first constituent of length;

operating a gripper to engage said end portion produced by said step of reducing;

drawing said starting metal blank only partly through a contoured die or only partly through each one of a succession of contoured dies to reduce the outside dimension essentially only along a part of said starting metal tube without producing an appreciable increase to the uniform wall thickness for producing a desired dimension along a second constituent length desired for said contoured workpiece;

working the metal of said starting metal blank concurrently with said step of drawing to form said second constituent of length in said starting metal blank; and cutting an increment of length essentially comprised of said end portion from said starting metal blank to define a desired aggregate length for said contoured workpiece.

* * * * *